United States Patent [19]

Siekanowicz et al.

[11] 4,088,920

[45] May 9, 1978

[54] FLAT DISPLAY DEVICE WITH BEAM GUIDE

[75] Inventors: Wieslaw Wojciech Siekanowicz, Trenton; Charles Hammond Anderson, Rocky Hill; Thomas Lloyd Credelle, East Windsor, all of N.J.

[73] Assignee: RCA Corporation, New York, N.Y.

[21] Appl. No.: 671,358

[22] Filed: Mar. 29, 1976

[51] Int. Cl.[2] ..... H01J 29/56; H01J 29/80; H01J 31/20

[52] U.S. Cl. ..... 313/422; 315/366

[58] Field of Search ..... 313/399, 95, 103, 104, 313/105, 409, 422

[56] References Cited

U.S. PATENT DOCUMENTS 3,148,304 9/1964 Veith et al. ..... 313/422

*Primary Examiner*—Robert Segal

*Attorney, Agent, or Firm*—G. H. Bruestle; D. S. Cohen

[57] ABSTRACT

An evacuated envelope includes front and back walls and a plurality of spaced, parallel supports between, and perpendicular thereto which form a plurality of parallel channels. A gun structure at one end of the channels directs one or more electron beams along each of the channels. In each of the channels is at least one beam guide which confines the electrons of the beam but permits selective deflection of the electron beam out of the guide toward a phosphor screen on the inner surface of the front wall. The beam guide includes electrodes on the inner surface of the back wall and either a single grid plate or a pair of spaced, parallel grid plates spaced from and parallel to the back wall. The beam guide also includes means for laterally confining the electrons of the beam which may include spaced parallel wires between the back wall and the grid plates and extending along the channel or a special configuration of the electrodes on the back wall.

33 Claims, 19 Drawing Figures

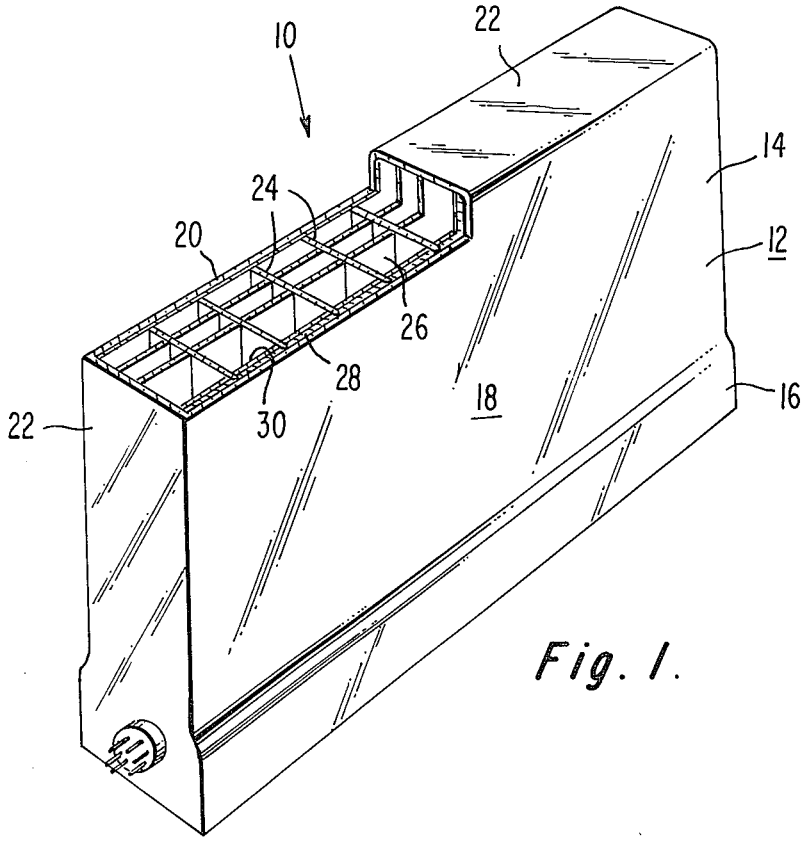
Fig. 1.
Fig. 2.
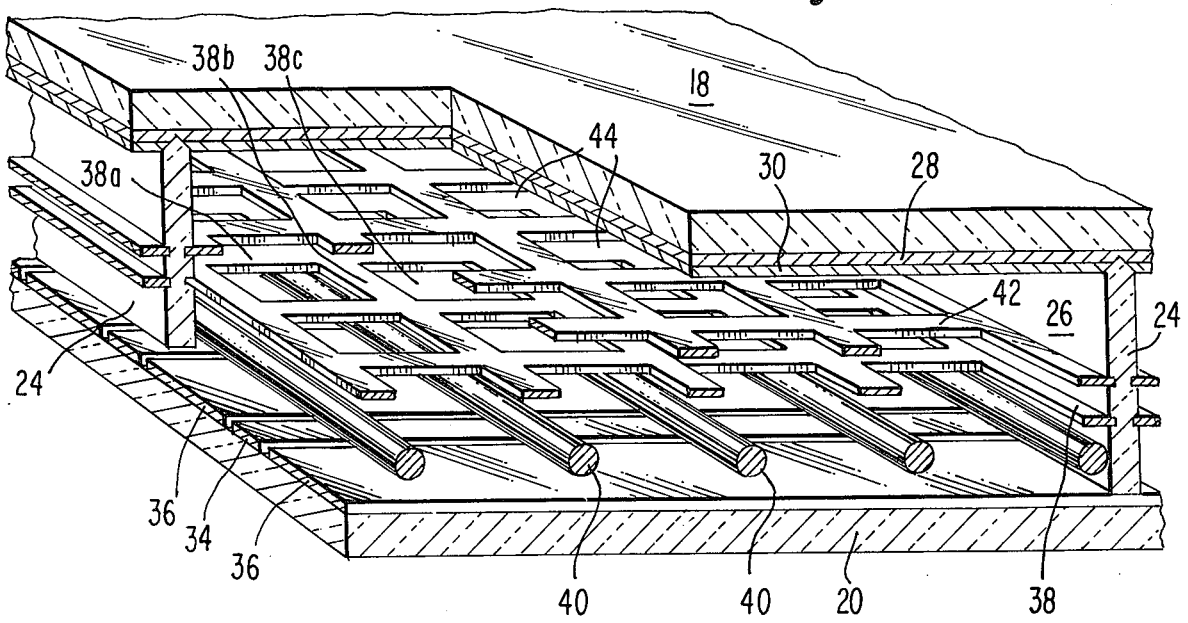

Fig.5.
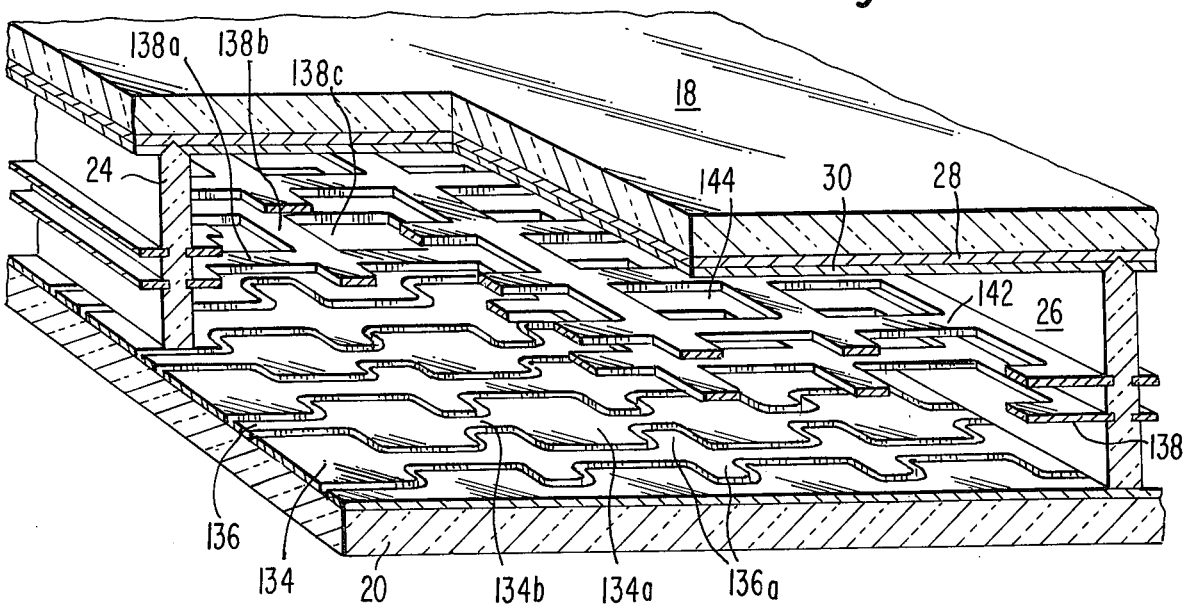
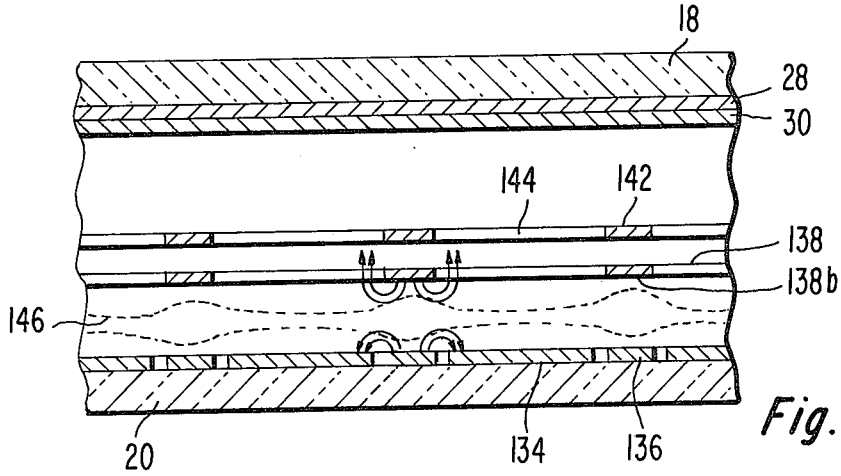
Fig.7.
Fig.8.
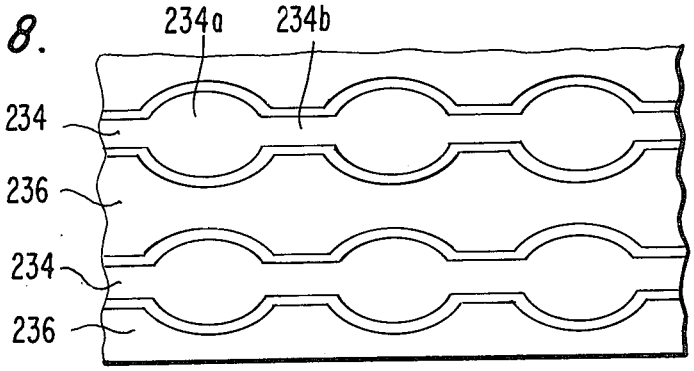

FLAT DISPLAY DEVICE WITH BEAM GUIDE

BACKGROUND OF THE INVENTION

The present invention relates to a flat image display device including apparatus for scanning electron beams over the image screen thereof, and particularly to a structure for confining and guiding the beams and for selectively deflecting the beams toward the image screen.

It has long been a desire to reduce the depth dimension of a picture tube to provide a substantially flat display device. One structure which has been proposed include a thin boxlike envelope with one of the large sides thereof constituting a faceplate on which a phosphor screen is disposed. An electron gun directs electrons across the tube in a path substantially parallel to the screen. Deflection elements are provided to selectively deflect the electrons onto successive points of the screen to achieve the desired scanning thereof. A tube of this type is shown in U.S. Pat. No. 2,928,014 to W. R. Aiken et al, issued Mar. 8, 1960 entitled "Electronic Device Cathode Ray Tubes."

In using this technique a problem has arisen in making flat display devices having large area screens, such as screens which are about 75 centimeters by 100 centimeters. For large size devices some type of internal support structure is required to prevent the evacuated tube from collapsing. A device having such internal support is shown in U.S. Pat. No. 2,858,464 to W. L. Roberts issued Oct. 28, 1958, entitled "Cathode Ray Tube." In a tube having internal structure, the confinement and guiding of the electron beam is more critical to prevent the supporting structure from interfering with the electron beam. As a beam of electrons moves away from its source, the electrons tend to spread out, making the size of the beam larger. If the electrons spread out enough to contact the supporting structure, parts of the tube become charged and cause malfunctioning of the tube.

As described in the copending application of T. O. Stanley, Ser. No. 607,492, filed Aug. 25, 1975, entitled "Flat Electron Beam Addressed Device" the confinement of the electron beam can be accomplished by means of beam guides which apply electrostatic forces to the electrons of the beam to confine the electrons in a relatively small beam as the beam travels along a path across the envelope. The beam guide also provides for deflection of the beam out of its path toward the phosphor screen at selective points along the beam path. For ease of construction of such a flat display device, it is desirable that the beam guides be of a relatively simple construction, i.e., the guide be made up of a minimum number of parts which can be easily assembled, yet still perform their desired function.

SUMMARY OF THE INVENTION

In a display device of the type described above, the guide means includes a plurality of spaced conductors extending transversely across the beam path on the side thereof opposite the screen in the envelope of the display device. A grid plate is spaced from and parallel to the beam path. The grid plate has a plurality of spaced openings therethrough along the beam path. The guide means also includes means extending along lines substantially parallel to and on opposite sides of the beam path for creating electrostatic forces which laterally confine the beam to the beam path.

BRIEF DESCRIPTION OF THE DRAWINGS

FIG. 1 is a perspective view, partially cut away, of a flat display device according to the present invention.

FIG. 2 is a perspective view, partially broken away, of a portion of one form of a beam guide of the present invention which can be used in the display device illustrated in FIG. 1.

FIG. 5 is a perspective view, partially broken away, of a modification of the beam guide shown in FIGS. 2–4 which can be used in the display tube illustrated in FIG. 1.

FIG. 7 is a longitudinal sectional view of a portion of the beam illustrated in FIG. 5 taken along lines 7—7 of FIG. 6.

FIG. 8 is a plan view of a portion of a modification of the electrodes which can be used in the form of the beam guide illustrated in FIG. 5.

DETAILED DESCRIPTION OF THE INVENTION

Figure 3:
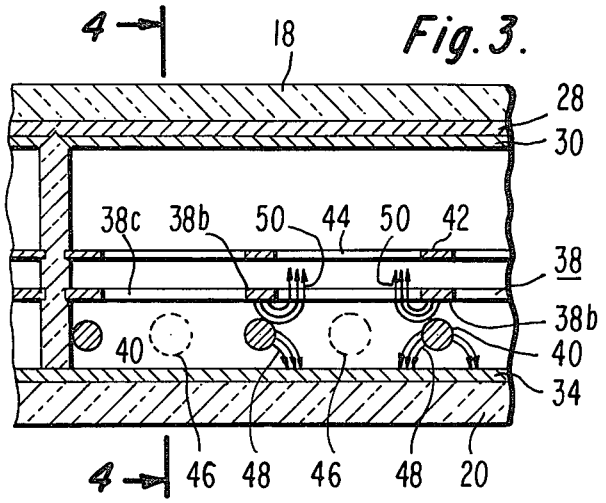
FIG. 3 is a transverse sectional view of a portion of the beam guide illustrated in FIG. 2.

Referring to FIG. 1, one form of a flat display device of the present invention is generally designated as 10. The display device 10 comprises an evacuated envelope 12, typically of glass, having a display section 14 and an electron gun section 16. The display section 14 includes a rectangular front wall 18 which supports the viewing screen, and a rectangular back wall 20 in spaced, parallel relation with the front wall 18. The front wall 18 and back wall 20 are connected by side walls 22. The front wall 18 and back wall 20 are dimensioned to provide the size of the viewing screen desired, e.g., 75 by 100 centimeters, and are spaced apart about 2.5 to 7.5 centimeters.

A plurality of spaced, parallel support walls 24 are secured between the front wall 18 and the back wall 20 and extend from the gun section 16 to the opposite side wall 22. The support walls 24 provide the desired internal support for the evacuated envelope 12 against external atmospheric pressure and divide the display section 14 into a plurality of channels 26. On the inner surface of the front wall 18 is a phosphor screen 28. The phosphor screen 28 may be of any well known type presently being used in cathode ray tubes, e.g., black and white or color television display tubes. A metal film electrode 30 is provided on the phosphor screen 28.

The gun section 16 is an extension of the display section 14 and extends along one set of adjacent ends of the channels 26. The gun section may be of any shape suitable to enclose the particular gun structure contained therein. The electron gun structure contained in the gun section 16 may be of any well known construction suitable for selectively directing beams of electrons along each of the channels 26. For example, the gun structure may comprise a plurality of individual guns mounted at the ends of the channels 26 for directing separate beams of electrons along the channels. Alternatively, the gun structure may include a line cathode extending along the gun section 16 across the ends of the channels 26 and adpated to selectively direct individual beams of electrons along the channels. A gun structure of the line type is described in U.S. Pat. No. 2,858,464 to W. L. Roberts, issued Oct. 28, 1958, entitled "Cathode Ray Tube."

In each of the channels 26 are focusing guides for confining electrons directed into the channel into a beam, which travels a path along the channel. Each guide also includes means for deflecting its beam out of the guide and toward the phosphor screen 28 at various points along the length of the channel 26.

Figure 4:
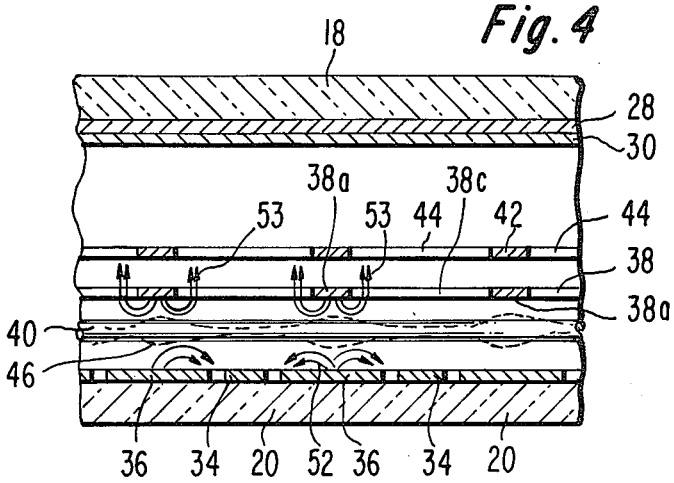
FIG. 4 is a longitudinal sectional view of a portion of the beam guide illustrated in FIG. 2 taken along line 4—4 of FIG. 3.

Referring to FIGS. 2, 3 and 4, there is shown one form of a focusing guide of the present invention in a channel 26. As shown, there are four focusing guides in each channel 26. However, each channel 26 may include any desired number of guides. The focusing guides include two interleaved sets of conductors 34 and 36 on the inner surface of the back wall 20 and extending transversely across the channels 26. The conductors 34 and 36 are strips of an electrically conductive material, such as a metal, coated on the inner surface of the back wall 20. The conductors 34 and 36 are in mutually spaced parallel relation and alternate along the entire length of the channel 26. The conductors 36 are preferably wider, i.e., the dimension longitudinally along the channel, than the conductors 34 although the conductors 36 and 34 can be of the same width.

A first metal grid plate 38 extends transversely across and along the channel 26 adjacent to but spaced from the back wall 20. The first grid plate is supported in grooves in the support walls 24. The first grid plate 38 is in the form of a mesh having two sets of orthogonal cross members **38*a* and 38*b*. One set of cross members 38*a* extend transversely across the channel 26 with each of the cross members 38*a* being directly opposite and parallel to a separate one of the conductors 36. The cross members 38*a* can be of substantially the same width as the conductors 36. They are preferably of a width slightly less than the conductors 36. The other set of cross members 38*b* extend longitudinally along the channel 26 in spaced, parallel relation. Thus, the cross members 38*a* and 38*b* form a plurality of rectangular openings 38*c* in the first grid plate 38 with the openings 38*c* being arranged in rows both longitudinally along the channel 26** and transversely across the channel.

A plurality of focusing electrodes 40 extend longitudinally along the channel 26 between and spaced from the first metal plate 38 and the conductors 34 and 36. The focusing electrodes 40 are in spaced parallel relation with each other, with each of the electrodes 40 extending along and opposite a separate one of the longitudinally extending cross members **38*b* of the first grid plate. As shown, each of the focusing electrodes 40 is of a metal wire of circular cross section and is of a diameter substantially equal to the width of the longitudinally extending cross member 38*b*. However, the electrodes 40 can be of any transverse cross section, but should be of a width no greater than the width of the longitudinally extending cross member 38*b***.

A second metal grid plate 42 extends along and transversely across the channel 26 adjacent to but spaced from the first metal plate 38 on the side of the first metal plate toward the front wall 18. The second grid plate 42 is supported in grooves in the support walls 24. The second grid plate 42 has a plurality of openings 44 therethrough. Each of the openings is substantially of the same size and is directly opposite a separate one of the openings **38*c* in the first grid plate 38. Thus, the openings 44 are arranged in rows extending longitudinally along the channel 26 with each row being positioned between a pair of adjacent focusing electrodes 40**.

In a typical focusing guide, the first grid plate 38 is spaced from the conductors 34 and 36 about 1.02 millimeters, and the second grid plate 42 is spaced from the first grid plate 38 about 0.25 millimeter. The focusing electrodes 40 are each of a diameter about 0.25 millimeter, are spaced from the conductors 34 and 36 about 0.25 millimeter and their center to center spacing is about 3.56 millimeters. In the first grid plate 38 the cross members **38*a* are of a width of about 0.61 millimeter and have a center to center spacing of 1.52 millimeters. The cross members 38*b* are of a width about 0.25 millimeter and are spaced apart a center to center distance of about 3.56 millimeters. The conductors 36 are of a width longitudinally of the channel of about 0.61 millimeter, and the conductors 34** are of a width about 0.41 millimeter.

In the operation of the display device 10, a high positive potential, typically about +125V, is initially applied to each of the conductors 34. The second grid plate 42 is maintained at approximately +180V. A low positive potential, typically about +56V, is applied to each of the conductors 36, the first grid plate 38 and each of the electrodes 40. The gun structure in the gun section generates electrons and directs a plurality of beams of the electrons into each channel 26. The beams of electrons are directed between the back wall 20 and the first grid plate 38 with each beam being between a pair of adjacent electrodes 40 so that the beams will follow a substantially straight path longitudinally along the channel 26. The electron beams are shown in phantom in FIGS. 3 and 4 and are indicated as 46.

As shown in FIG. 3, the potential difference between the electrodes 40 and the conductors 34 creates an electrostatic force field therebetween as indicated by the arrows 48. The potential difference between the first grid plate 38 and the second grid plate 42 also creates an electrostatic force field from the cross-member **38*b* through the openings 38*c* to the second grid plate 42 as indicated by the arrows 50. These electrostatic fields apply forces to the electrons of the beams 46 which prevent or limit movement of the electrons laterally in the guide so as to maintain the lateral position of the beams 46** as they flow along the guide.

As shown in FIG. 4, the difference in potentials between the conductors 34 and the conductors 36 creates electrostatic force fields between the conductors as indicated by the arrows 52. An electrostatic force field, indicated by the arrows 53, extends between the cross-members **38*a* of the first grid plate 38 and the second grid plate 42 through the openings 38*c* in the first grid plate. As each electron beam moves along between the first grid plate 38 and the conductors 34 and 36, the electrostatic fields apply periodic confining forces to the electrons in the manner described on pages 208 and 209 of the textbook "Theory and Design of Electron Beams," by J. R. Pierce, published by D. Van Nostrand Co., Inc. in 1954 to achieve periodic focusing of the electrons. The combination of the periodic focusing and the lateral confinement of the electrons confines the electrons in the beam along the entire length of the guide or until such time as it is extracted therefrom. Thus, each focusing guide includes a pair of adjacent electrodes 40 and the portions of the conductors 34 and 36 and the first and second grid plates 38 and 42 which extend transversely between the electrodes 40**.

To extract the electron beam 46 from the guide, the potential applied to a conductor 34 is switched to a negative voltage, such as −60V. When the electron beam reaches this conductor 34 the beam will be attracted by the high potential on the second grid plate 42 and will bend away from the negative potential conductor 34 and pass through the adjacent opening **38*c* in the first grid plate 38 and the aligned opening 44 in the second grid plate 42 to pass out of the beam guide. The electron beam 46 will be attracted to the phosphor screen 28 by a high potential applied to the metal film 30** so that the electron beam will impinge on the phosphor screen.

In one manner of operation of the display device 10, the conductor 34 closest to the side wall 22 directly opposite the gun section 16 is first switched to the low potential. Thus, all of the beams 46 in all of the channels 26 will be deflected at a point close to that side wall 22 to pass out of their respective guides and impinge on the phosphus screen 38 to provide a line scan of the phosphor screen 28. The electrodes 34 are then switched to a lower potential in sequence along the entire length of the channels so that the beams are extracted from the guides at various points along the length of the guides to provide a line-by-line scan of the phosphor screen 28. By carrying out this switching at the proper speed and by modulating the various beams in the gun section 16 during each line scan, a visual display can be provided on the phosphor screen 28 which can be viewed through the front wall 18 of the envelope 12. Alternatively, the line scan can be started at a point close to the gun section 16 and subsequently moved toward the opposite side wall 22, or the switching of the potential applied to the various electrodes 34 can be carried out in any desired order to achieve a desired display on the phosphor screen 28.

Figure 6:
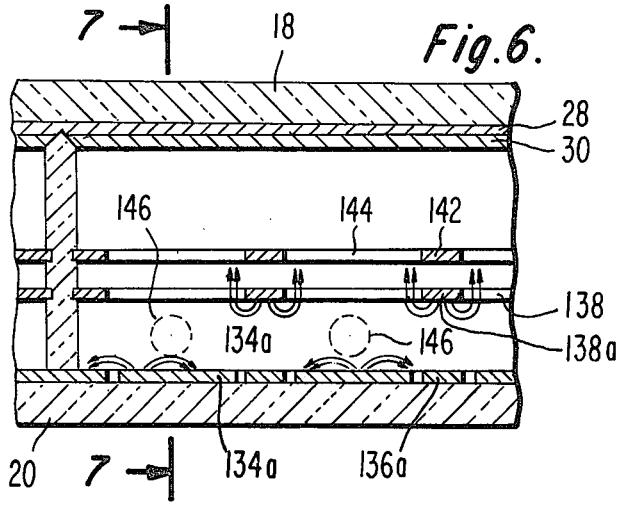
FIG. 6 is a transverse sectional view of a portion of the beam guide illustrated in FIG. 5.

Referring to FIGS. 5, 6 and 7, there is shown a modification of the focusing guide which can be used in the display device 10. This modified guide is substantially identical to the guide shown in FIGS. 2–4 with the exception that the electrodes 40 are omitted and the conductors 34 and 36 are replaced by conductors 134 and 136 which are designed to provide the focusing function provided by the electrodes 40.

The conductors 134 and 136 are each strips of an electrically conductive material, such as a metal, coated on the back wall 20 and alternating along the entire length of the channel 26. Each of the conductors 134 includes a plurality of rectangular first regions **134*a* spaced along the conductor laterally across the channel 26 and narrow connecting region 134*b* connecting adjacent first regions 134*a*. Each of the first regions 134*a* is of a size slightly smaller in area than and is in alignment with, a separate opening 138*c* in the first grid plate 138. The connecting regions 134*b* lie opposite the longitudinally extending cross-members 138*b* intermediate the transversely extending cross-members 138*a*. Each of the conductors 136 extends along and is parallel to a separate transversely extending cross-member 138*a* of the first grid plate 138 and is of a width substantially equal to the width of the transversely extending cross member 138*a*. Each of the conductors 136 includes projections 136*a* extending into the spaces between adjacent first regions 134*a* toward the connecting regions 134*b*. Thus, each of the projections 136*a* lies directly opposite, and is of a width not greater than that of, a longitudinal cross member 138*b* of the first metal grid 138**.

In a typical focusing guide, the first grid plate 138 is spaced from the conductors 134 and 136 about 0.76 millimeter, and the second grid plate 142 is spaced from the first grid plate 138 about 0.25 millimeter. The cross members **138*a* of the first grid plate 138 are of a width of about 0.51 millimeter and have a center to center spacing of 1.52 millimeters. The cross members 138*b* are of a width about 0.25 millimeter and are spaced apart a center-to-center distance of about 3.56 millimeters. As previously described, the dimensions of the conductors 134 and 136 correspond to the dimensions of the cross members 138*a* and 138*b* and the openings 138*c* of the first grid plate 138**.

In the operation of the display device 10 incorporating the above-described focusing grid, the voltages applied and the mode of operation is substantially identical to that previously described for the focusing guide shown in FIGS. 2–4. As shown in FIG. 7 as each beam 146 flows along the guide the electrons are periodically compressed together by electrostatic forces between the conductor 134 and 136 and between the grid plates 132 and 142 to achieve confinement of the electrons in the beam. As shown in FIG. 6 laterally confinement of the electrons in the beam 146 is achieved by the electrostatic forces between the grid plates 138 and 142 and between the projections **136*a* of the conductors 136 and the first regions 134*a* of the conductors 134. Extraction of the electron beam 146 from the beam guide is achieved in the same manner previously described by switching the potential applied to a conductor 134 to a negative voltage, such as −60V. Thus, in this modification of the focusing guide the lateral confinement is achieved with the aid of the design of the conductors 134 and 136 rather than with the focusing electrodes 40. Since the conductors 134 and 136 are metal films coated on the surface of the back wall 20, it is easier to form the conductor of any desired shape than to properly mount the wire electrodes 40 between and in spaced relation to the back wall 20 and the first metal plate 38**.

Figure 9:
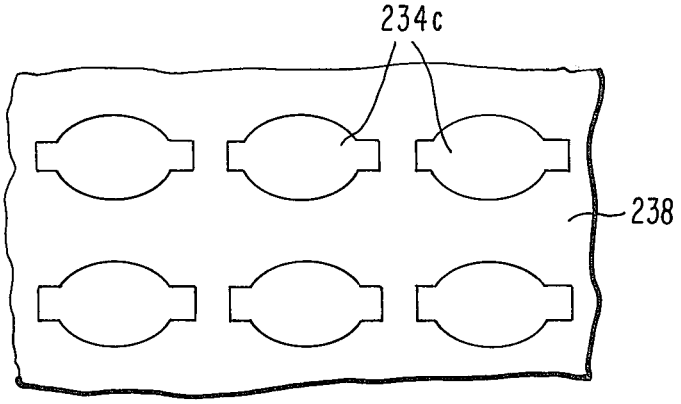
FIG. 9 is a plan view of a portion of a modification of one of the grid plates which would be used with the electrodes illustrated in FIG. 8 in the form of the beam guide illustrated in FIG. 5.

In the modified focusing guide the rectangular shape of the first regions 134*a* of the conductors 134 tend to create field crowding at the corners of the regions which could cause undersirable breakdowns. Therefore, it may be desirable to make the shape of the first regions more rounded to eliminate the sharp corners. For example, FIG. 8 shows a conductor 234 having spaced first regions 234*a* which are substantially elliptical in shape with the major axis extending laterally across the channels 26. The elliptical first regions 234*a* are connected by narrow connecting regions 234*b* which extend from the end of the major axes of the first regions. The conductors 236 are shaped to follow the contours of the conductors 234. The rounded shape of the first regions 234*a* not only minimizes breakdown but also makes the confining forces more uniform around the electron beam. If the first regions of the conductors 234 are made rounded, the openings in the first grid plate should be made to correspond with the shape of the first regions. For example, FIG. 9 shows a first grid 238 having openings 238*c* therethrough which correspond to the elliptical shape of the first regions 234*a* of the conductors 234.

Figure 10:
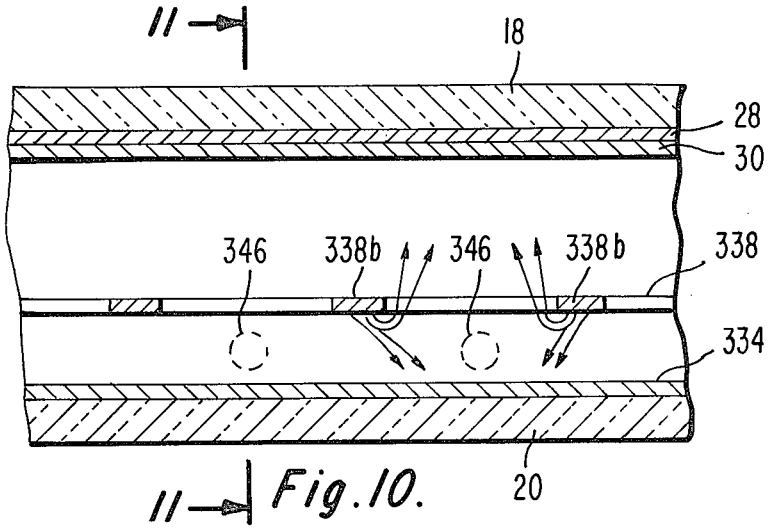
FIG. 10 is a transverse sectional view of another form of the beam guide of the present invention.
Figure 11:
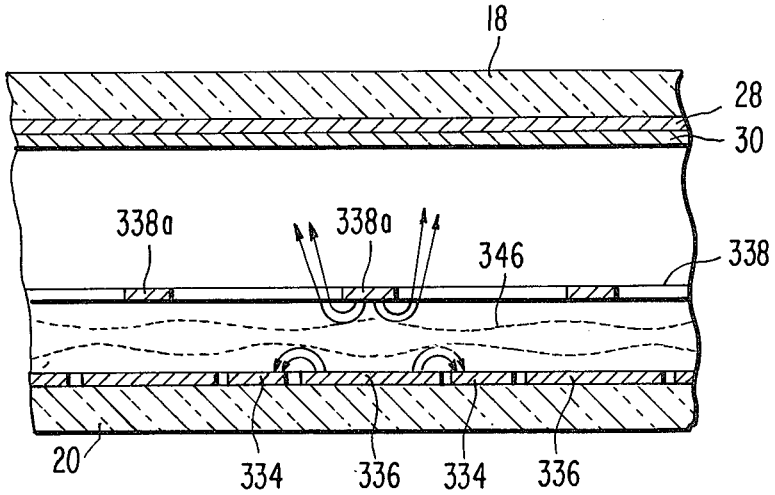
FIG. 11 is a sectional view taken along line 11—11 of FIG. 10.

Referring to FIGS. 10 and 11 there is shown a second modification of the focusing guide which can be used in the display device 10. This second modification of the focusing guide is substantially identical to the focusing guide shown in FIGS. 2–4 with the exception that the electrodes 40 and the second grid plate 42 are omitted. This second modification of the focusing guide operates in substantially the same manner as previously described for the guide shown in FIGS. 2–4. However, as shown in FIG. 10, the lateral confinement of the electrons in the beam 346 is achieved by the forces from the electrostatic force fields between the longitudinally extending cross members 338*b* of the grid plate 338 and each of the conductors 334 and the metal film 30 on the phosphor layer 28. The metal film 30 is generally at a high potential, +2000V to +8000V, which depends on the potential of the cathode which generates the electrons in the gun section 16 and the distance between the metal film 30 and the grid plate 338. With a distance of about 17.02 millimeter between the metal film 30 and the grid plate 338 a potential of about +5000V provides the desired electrostatic field. If this spacing is larger the voltage should be greater and if the spacing is less the voltage can be less.

As shown in FIG. 11, as the electron beam 346 moves along the guide, periodic compression of the beam is achieved by the forces applied by the force fields between the conductors 334 and 336 and between the transversely extending cross members 338*a* of the grid plate 338 and the metal film 30. Also as previously described with regard to the focussing guide shown in FIGS. 2–4, extraction of the electron beam 346 from the guide is achieved by switching the potential applied to the conductors 334 to a negative potential, such as −10V. Thus, this focussing guide operates in a manner substantially the same as the focussing guide shown in FIGS. 2–4. However, this focussing guide is much simpler in construction than the focussing guide shown in FIGS. 2–4 in that it includes only a single grid plate.

The focussing guide shown in FIGS. 2–4 and the focussing guide shown in FIGS. 10 and 11 can both be operated with all of the conductors on the back wall 20, i.e., the conductors 34 and 36 and the conductors 334 and 336, being at the same high potential, e.g., +125V, rather than some being at the high potential and the others being at a low potential. Having all of the conductors at the same potential has the advantage that the circuitry for the guide is simpler. Also, each of one set of the conductors can be combined with an adjacent one of the other set of conductors so that there are fewer number of the conductors with each conductor being wider. The disadvantages of this manner of operation is that it reduces the electrostatic focussing field so that the focussing forces on the beam are reduced and the current handling capability of the guide is reduced.

Figure 12:
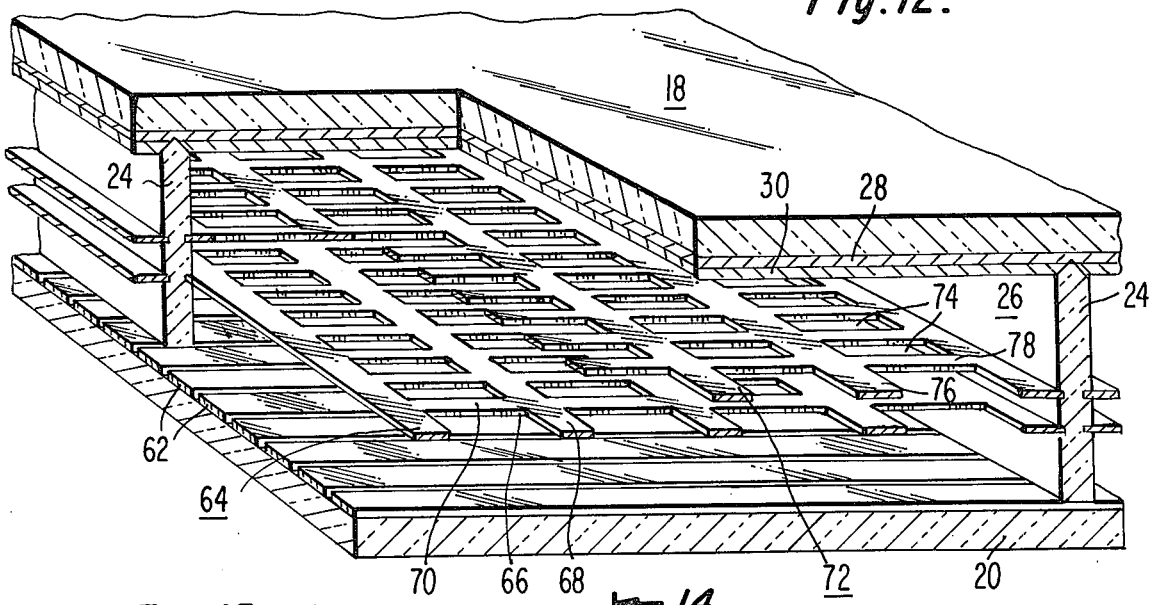
FIG. 12 is a perspective view, partially broken away, of a portion of still another form of beam guide of the present invention which can be used in the display device illustrated in FIG. 1.
Figure 13:
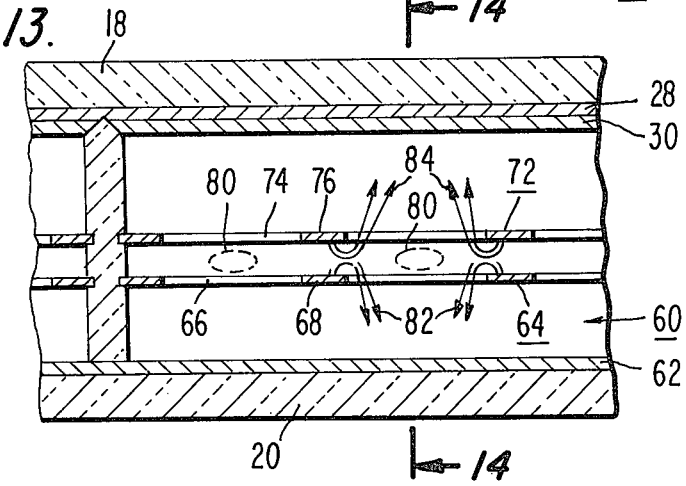
FIG. 13 is a transverse sectional view of a portion of the beam guide shown in FIG. 12.
Figure 14:
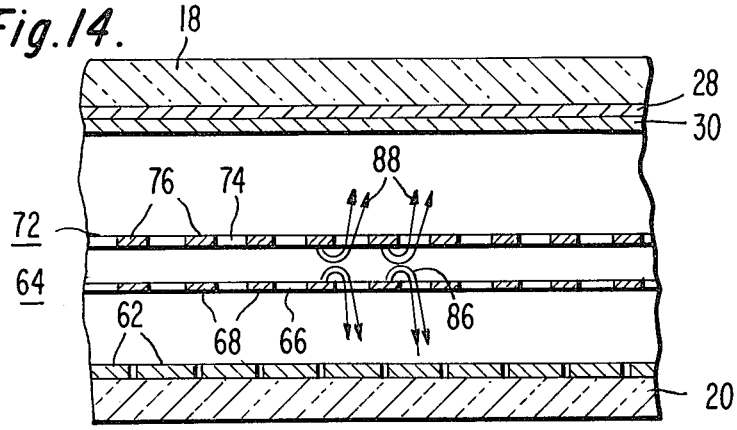
FIG. 14 is a sectional view taken along line 14—14 of FIG. 13.
Figure 15:
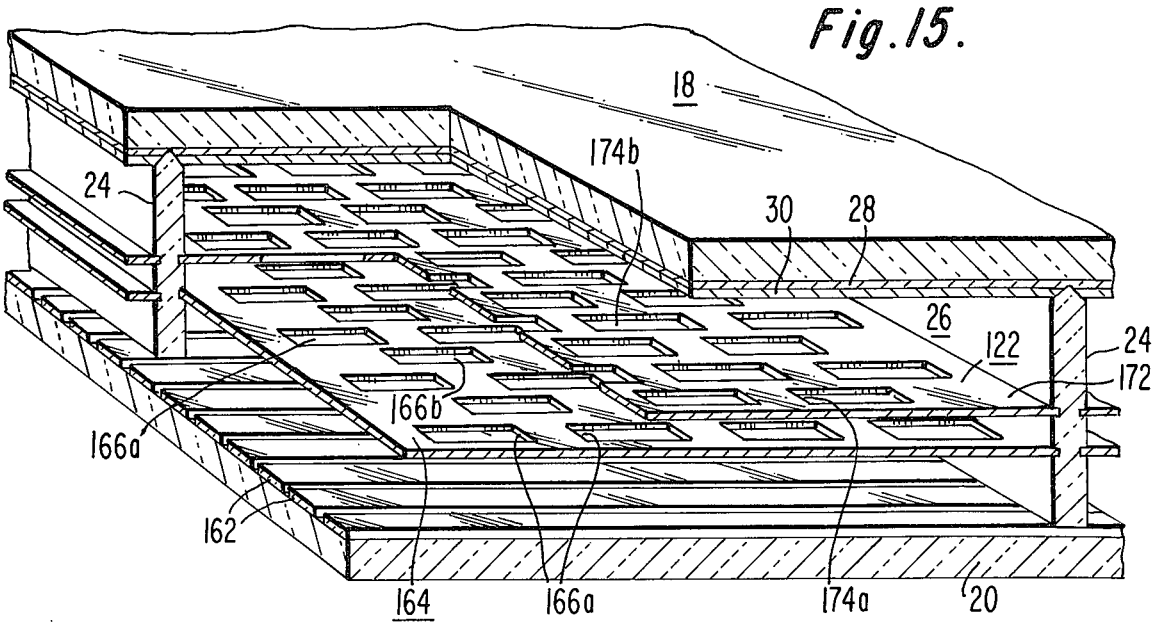
FIG. 15 is a perspective view, partially broken away, of a portion of a modification of the beam guide shown in FIGS. 12–14 which can be used in the display device illustrated in FIG. 1.

Referring to FIGS. 12–14, there is shown yet another form of the focussing guide of the present invention which can be used in the display device 10. There are a plurality, four as shown, of focussing guides in each channel 26 of the envelope 12 between the support walls 24. The focussing guides include a plurality of spaced, parallel conductors 62 on the inner surface of the back wall 20 extending transversely across the channel 26. The conductors 62 are strips of an electrically conductive material, such as a metal, coated on the back wall 20.

A first metal grid plate 64 extends transversely across the channel 26 adjacent to but spaced from the back wall 20. The first grid plate 64 is supported in grooves in the supporting walls 24. The first grid plate 64 has a plurality of spaced, rectangular openings 66 therethrough. The openings 66 are arranged in rows both longitudinally along and transversely across the channel 26. This arrangement of the openings 66 provides the first grid plate 64 with longitudinal cross members 68 extending between the longitudinal rows of the openings 66 and transverse cross members 70 extending between the transverse rows of the openings 66. The openings 66 in each transverse row are over a separate one of the conductors 62.

A second metal grid plate 72 extends transversely across the channel 26 adjacent to but spaced from the first grid plate 64 on the side of the first grid plate 64 toward the front wall 18. The second grid plate 72 has a plurality of spaced, rectangular openings 74 therethrough. The openings 72 are arranged in rows both longitudinally along and transversely across the channel 26 with each of the openings 74 being over a separate one of the openings 66 in the first grid plate 64. Thus, the second grid plate 72 has longitudinally extending cross members 76 between the longitudinal rows of the openings 74 and transversely extending cross members 78 between the transverse rows of the openings 74.

In a typical focussing guide of this type, the conductors 62 are each of a width, i.e., the dimension longitudinally along the channel 26, of about 1.25 millimeters and are spaced apart about 0.25 millimeter. The first grid plate 64 is spaced from the conductors 62 and 0.25 millimeter and the second grid plate 72 is spaced from the first grid plate 64 about 0.76 millimeter. The openings 66 and 74 in the grid plates 64 and 70 respectively each have a dimension transversely of the channel 26 of about 3.30 millimeters and a dimension longitudinally of the channel 26 of about 0.91 millimeter. The openings in each of the grid plates are spaced apart trasversely on the channel 26 about 1.78 millimeters and longitudinally of the channel 26 about 0.61 millimeter.

In the operation of the display device having this focussing guide, a high positive potential, typically about +200V, is applied to each of the conductors 62 and a low positive potential, typically about +50V, is applied to each of the first and second grid plates 64 and 72. Beams of electrons 80 are directed into the focussing guides between the first grid plate 64 and the second grid plate 72 with each beam 80 extending a substantially straight line path along a separate longitudinal row of the openings in the grid plates.

As shown in FIG. 13, the potential difference between the first grid plate 64 and the conductors 62 creates an electrostatic force field between the longitudinal cross members 68 of the first grid plate 64 and the conductors 62 as indicated by the arrows 82. An electrostatic force field, indicated by the arrows 84, extends between the longitudinal cross members 76 of the second grid plate 72 and the metal film 30 on the phosphor layer 28 as a result of the potential difference between the second grid plate 72 and the metal film 30. As previously stated with regard to the focussing guide shown in FIGS. 10 and 11, the metal film 30 is generally at high positive potential, +2000V to +8000V, which depends on the potential of the cathode which generates the electrons in the gun section and the distance between the metal film 30 and the second grid plate 72.

As shown in FIG. 14, the difference in potentials between the first grid plates 64 and the conductors 62 creates an electrostatic force field between the transverse cross members 68 of the first grid plate and the conductors 62 as indicated by the arrows 86. The difference in potentials between the second grid plate 72 and the metal film 30 creates electrostatic force fields between the transverse cross members 76 of the second grid plate and the metal film 30 as indicated by the arrows 88. These electrostatic fields apply forces to the electrons of the beams 80 which results in a periodic compression of the beam as the beam travels along a substantially straight path between grid plates 64 and 72. The combination of all of the forces applied to the electrons of each electron beam 80 by all of the electrostatic force fields confines the electrons in the beam along the entire length of the path of the beams through the focussing guide. As in the form of the focussing guide previously described, extraction of the electron beams from this focussing guide is achieved by switching the potential applied to the conductors 62 to a negative potential, such as −100 V.

This focussing guide has the advantage over the focussing guide shown in FIGS. 2–4 and the focussing guide shown in FIGS. 5–6 of being simpler in construction in that it does not require either the focussing electrodes or special shaping of the conductors to achieve the lateral confinement of the electrons in the beam. Also, all of the conductors, except the conductor which is switched to a negative potential for extracting the beam, are at the same potential so as to simplify the operating circuitry and minimize power loss. Although this focussing guide is more complicated in structure than the focussing guide shown in FIGS. 10 and 11 in that it has two grid plates rather than one, this focussing guide does have the advantages resulting from all of the conductors being at the same potential. Even if the focussing guide shown in FIGS. 10 and 11 is operated with all of the conductors being at the same potential as previously described, this focussing guide has the advantage of providing greater focussing forces on the beams.

Referring to FIGS. 15–18, there is shown a modification of the focussing guide shown in FIGS. 12–14. This focussing guide like the focussing guide shown in FIGS. 12–14, includes a plurality of spaced, parallel conductors 162 on the back wall 20 and extending transversely across the channels 26, and first and second metal grid plates 164 and 172 extending transversely across the channel 26 and supporting in grooves in the support walls 24. The first grid plate 164 has therein two sets of rectangular openings **166*a* and 166*b* respectively. The openings in each set are arranged in rows both transversely and longitudinally of the channel 26. The transverse rows of the openings 166*b* are intermediate the transverse rows of the openings 166*a*. Also the longitudinal rows of the openings 166*b* are between the longitudinal rows of the openings 166*a*. The openings 166*b* in each longitudinal row extend transversely across portions of the openings 166*a* in each adjacent longitudinal row. This overlapping of the openings 166*a* and 166*b*** provides a plurality of longitudinal rows of overlapping end portions of the openings with each opening being in two of such longitudinal rows.

The second grid plate 172 also has therein two sets of rectangular openings **174*a* and 174*b* respectively. The openings are arranged in rows extending transversely across and longitudinally along the channel 26. The transverse rows of the openings 174*b* are intermediate the transverse rows of the openings 174*a* and the longitudinal rows of the openings 174*b* are between the longitudinal rows of the openings 174*a*. The openings 174*b* in each of the longitudinal rows extend transversely across a portion of the openings 174*a* in each adjacent longitudinal row. Thus, there is provided a plurality of longitudinal rows of overlapping end portions of the openings 174*a* and 174*b*** with each opening being in two of such longitudinal rows.

Each transverse row of openings **174*a* in the second grid plate 172 is over a transverse row of openings 166*a* in the first grid plate 164, and each transverse row of openings 174*b* in the second grid plate 172 is over a transverse row of openings 166*b* in the first grid plate 164. However, in each transverse row of the openings 174*a* in the second grid plate 172 each of the openings 174*a* is located transversely between and extends transversely across portions of two of the openings 166*a* in the corresponding transverse row of the openings 166*a* in the first grid plate 164. Like in each transverse row of the openings 174*b* in the second grid plate 172, each of the openings 174*b* is located transversely between and extends transversely across portions of two of the openings 166*b* in the corresponding transverse row of the openings 166*b* in the first grid plate 164**.

In the operation of the display device 10 having this focussing guide, a high positive potential, typically about +200 V, is applied to each of the conductors 162 and a low positive potential, typically about +50 V, is applied to each of the first and second grid plates 164 and 172. Beams of electrons 180 are directed into the focussing guides between the first and second grid plates 164 and 172. Each beam 180 is directed along a substantially straight line path which extends along a longitudinal row of overlapping end portions of the openings in the grid plate.

Figure 16:
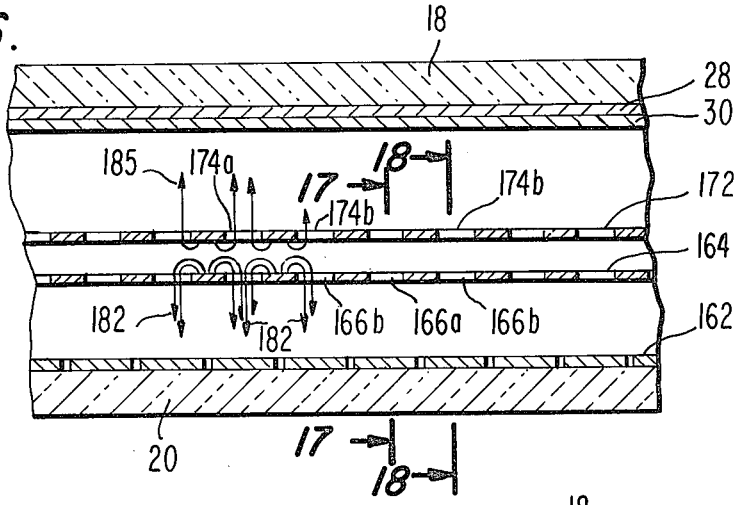
FIG. 16 is a longitudinal sectional view of the beam guide shown in FIG. 15 along a portion of one of the beam paths.
Figure 17:
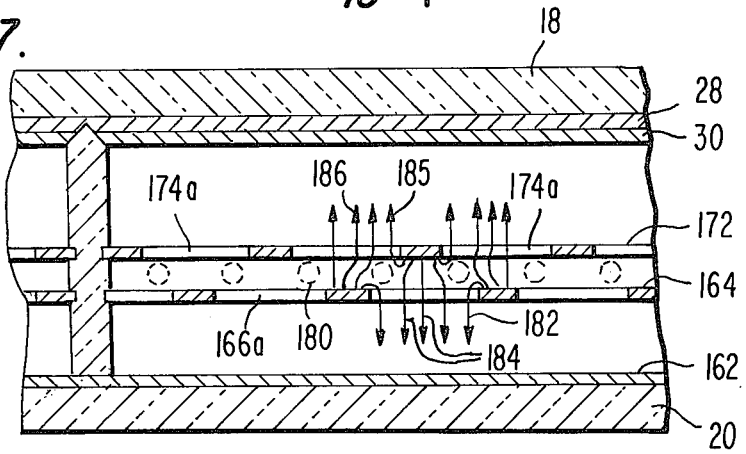
FIG. 17 is a sectional view taken along line 17—17 of FIG. 16.
Figure 18:
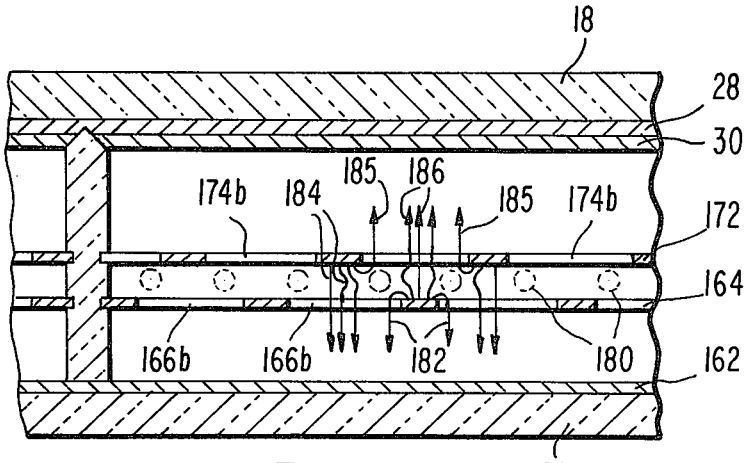
FIG. 18 is a sectional view taken along line 18—18 of FIG. 16.

As shown in FIGS. 16, 17 and 18, the potential difference between the first grid plate 164 and the conductors 162 creates an electrostatic force field therebetween which extends through the openings 166*a* and 166*b* as indicated by the arrows 182. The potential difference between the second grid plate 172 and the conductors 162 creates an electrostatic force field therebetween which also extends through the openings 166*a* and 166*b* in the first grid plate 162 as indicated by the arrows 184. The potential difference between the second grid plate 172 and the metal film 30, which is previously described as at a high positive potential, creates an electrostatic force field therebetween which extends through the openings 174*a* and 174*b* in the second grid plate as indicated by the arrows 185. The potential difference between the first grid plate 164 and the metal film 30 creates an electrostatic force field therebetween which also extends through the openings 174*a* and 174*b* in the second grid plate 172 as indicated by the arrows 186. These electrostatic fields surround the electron beam 180 and apply forces to the electrons which confine the electrons to the beams 180 as the beams travel along their paths through the guides. As in the other focussing guides previously described, extraction of the beams 180 from the focussing guides is achieved by switching the potential applied to the conductors 162 to a negative voltage.

This focussing guide has the advantage over the focussing guides shown in FIGS. 12–14 of being capable of providing a greater number of guides per lateral width of the envelope. In the device shown in FIGS. 12–14, there is a single beam guide along each longitudinal row of the grid plate openings. However, in this device there is a beam path along each lateral end of each longitudinal row of the grid plate openings. Thus, this device includes about twice the number of guides as the device shown in FIGS. 12–14 assuming that both devices are of the same lateral dimension and the grid plate openings are of the same dimensions. The greater the number of focussing guides the greater the number of electron beams that can be included in the display device.

Figure 19:
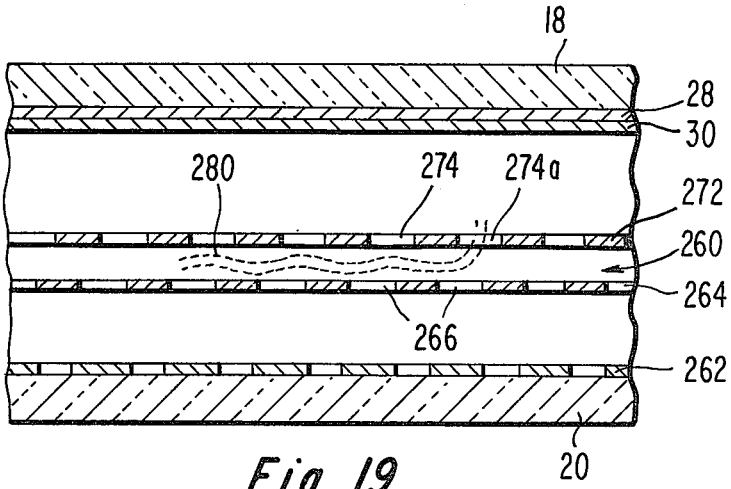
FIG. 19 is a longitudinal sectional view illustrating another modification of the focusing beam guides shown in FIGS. 12–18.

Referring to FIG. 19, there is shown another modification of the focussing guide which can be used in the display device 10. This focussing guide like the focussing guide shown in FIGS. 12–14 and the focussing guide shown in FIGS. 15–18 includes a plurality of spaced, parallel conductors 262 on the back wall 20 and extending transversely across the channels, and first and second metal grid plates 264 and 272 extending transversely across the channel. The first grid plate 264 has a plurality of rectangular openings 266 therethrough and the second grid plate 272 has a plurality of rectangular openings 274 therethrough. The grid plate openings 266 and 272 may be arranged in the manner shown in FIGS. 12–14 or in the staggered arrangement shown in FIGS. 15–18. However, in this focussing guide, each transverse row of the second grid plate openings 272 is offset longitudinally from a transverse row of the first grid plate openings 266 rather than being directly over the transverse row of the first grid plate openings. The longitudinal offset is in the direction along the direction of the electron beam travel.

These focussing guides operate in the same manner as the focussing guides shown in FIGS. 12–14 and in FIGS. 15–18 previously described depending on the arrangement of the grid plate openings. However, in these focussing guides, the longitudinal offset of the second grid plate openings 272 with respect to the first grid plate openings 266 creates an electrostatic force field around the electron beam 280 which causes the beam to wobble slightly back and forth between the grid plates as the beam travels along its substantially straight path in between the grid plates. As shown in FIG. 19, the electrostatic forces on the electron beam 280 cause the beam to move slightly toward the second grid plate 272 as the beam travels longitudinally across each of the openings 274 in the second grid plate and to move slightly toward the first grid plate 264 as the beam travels longitudinally across each of the openings 266 in the first grid plate. To extract the electron beam 280 from the focussing guide 260, the potential applied to one of the conductors, such as the conductor 262*a*, is switched to a negative potential. This applies an electrostatic force on the electron beam to cause it to be deflected toward the second grid plate 272. The beam 280 then flows through an adjacent opening 274*a* in the second grid plate 272 to pass out of the focussing guide toward the phosphor screen 28 as shown in FIG. 19. Since, as previously described, the electron beam 280 is wobbling toward the second grid plate opening 274*a* the force necessary to cause the beam to continue its movement to the opening 274*a* is not as great as if the beam was not wobbling toward the opening 274*a*. Thus, in these focussing guides extraction of the electron beam can be achieved with lower extraction voltages than is required in the focussing guides shown in FIGS. 12–14 and in FIGS. 15–18.

In the focussing guides shown in FIGS. 10 and 11 which include only a single grid plate 338, a slight wobbling of the electron beam 346 can be similarly achieved by shifting the positions of the openings 338*c* longitudinally with respect to the electrodes 334 in the direction of the travel of the beams 346.

Although the display device 10 has been shown to have support walls between the back and front walls to prevent collapse of the evaporated envelope 12, any type of supports, such as support posts, may be used in place of the walls. No matter what type of supports are used between the front and back walls they should be arranged to provide channels extending from the gun section 16 to the side wall opposite the gun section. Also, although the various grid plates are shown to be individual grid plates extending across each channel and mounted on the support walls, each of the grid plates can be a single plate extending across all of the channels. The display device 10 may be provided with additional grids between the focussing guides and the metal film 30 on the phosphor screen 28 which serve as focussing or accelerating guides for the electron beams as the beams flow from the focussing guide to the phosphor screen 28. If any of the novel functions of the display device shown in FIGS. 10–19, which utilize the potential difference between the metal film 30 and one of the grid plates to provide a portion of the confinement force on the electrons of the beam, include such an additional grid, a difference in potential between the grid plate of the focussing guide and the adjacent additional grid can be used to provide the required portion of the confinement forces.

We claim:

1. A display device comprising an evacuated envelope, a phosphor screen within said envelope, means in said envelope for generating and directing electrons in a substantially straight path parallel to said screen, and guide means along said path for confining the electrons in a beam and deflecting the beam toward said phosphor screen at selected points along said path, said guide means including a plurality of spaced conductors extending transversely of said beam path, on the side thereof opposite said screen, a grid plate spaced from and parallel to said beam path, said grid plate having a plurality of spaced openings therethrough along said beam path, and means extending along lines substantially parallel to and on opposite sides of said beam path for creating forces which laterally confine said beam to said beam path.

2. A display device in accordance with claim 1 in which said grid plate is between said beam path and the screen.

3. A display device in accordance with claim 2 wherein the conductors include two sets of conductors which are in spaced alternating relation along the path of the beam, the conductors of one set are each positioned in alignment with a separate opening in the grid plate and each of the conductors of the other set being positioned between the openings in the grid plate.

4. A display device in accordance with claim 3 in which the guide means includes a second grid plate between the first said grid plate and the screen, said second grid plate having spaced openings therein each of which is over a separate opening in the first grid plate.

5. A display device in accordance with claim 4 in which the means for creating forces which laterally confine the beams includes a pair of electrodes extending parallel to and on opposite sides of the beam path between the first grid plate and the conductors.

6. A display device in accordance with claim 4 in which the means for creating forces which laterally confine the beam includes projections on each of the conductors of the other set which projections extend parallel to and on opposite sides of the beam path along portions of an adjacent conductor of the one set.

7. A display device in accordance with claim 1 in which said grid plate is between the conductors and the beam path and a second grid plate is in spaced parallel relation to said first grid plate between the beam path and the screen, said second grid plate having spaced openings therein each of which is at least partially over a separate opening in the first grid plate.

8. A display device in accordance with claim 1 including means for generating and directing electrons along a plurality of spaced parallel substantially straight paths each of which is between and substantially parallel to the front and back walls, and the guide means is along all of said paths.

9. A display device in accordance with claim 8 in which the grid plate is between said beam paths and the screen and includes a separate row of openings along each of said beam paths.

10. A display device in accordance with claim 9 in which the conductors include two sets of conductors which are in spaced alternating relation along the paths of the beams, the grid plate includes a first set of spaced, parallel cross member extending transversely across the beam paths and a second set of spaced parallel cross members extending longitudinally along the beam paths, said cross members forming therebetween the openings in the grid plate which are over one set of the conductors, each of the cross members of said first set extending along a separate one of the other set of conductors and the cross members of the second set being spaced so that each beam path extends between two of the cross members of the second set.

11. A display device in accordance with claim 10 in which the guide means includes a second grid plate between the first said grid plate and the screen, said second grid plate having spaced openings therein each of which is over a separate opening in the first grid plate.

12. A display device in accordance with claim 11 in which the means for creating forces which laterally confine the beams includes a plurality of electrodes extending between the first grid plate and the conductors with each of the electrodes extending longitudinally along a separate one of the cross members of the second set.

13. A display device in accordance with claim 11 in which the means for creating forces which laterally confine the beams includes projections on each of the conductors of the other set which projections extend along the cross members of the second set.

14. A display device in accordance with claim 13 in which each of the conductors of the one set includes a plurality of spaced first regions each of a shape and size corresponding to and positioned in alignment with a separate opening in the first grid plate and narrow connecting regions extending between said first regions across the cross members of the first set, and the projections on the conductors of the other set extend between the first region toward the connecting regions.

15. A display device in accordance with claim 8 in which said grid plate is between the conductors and the beam path and includes a row of openings along each of said beam paths, and a second grid plate is in spaced parallel relation to said first grid plate between the beam path and the screen, said second grid plate having spaced openings therein each of which is at least partially across at least one of the openings in the first grid plate.

16. A display device in accordance with claim 15 in which the openings in each of the grid plates are arranged in rows extending transversely across the beam paths and in rows extending longitudinally along the beam paths, the openings in each of the longitudinal rows extending laterally across at least one of the beam paths, and each transverse row of the openings extending along a separate one of the conductors.

17. A display device in accordance with claim 16 in which each of the openings in the second grid plate extends across a separate opening in the first grid plate and each of the longitudinal rows of the openings extends along a separate beam path.

18. A display device in accordance with claim 16 in which each grid plate includes a first set of openings arranged in rows extending transversely across and longitudinally along the beam paths and a second set of openings in rows extending transversely across and longitudinally along the beam path, each transverse row of said second set of openings being between a pair of transverse rows of said first set of openings and each longitudinal row of said second set of openings being between two longitudinal rows of the first set of openings and each of said second set of openings extending transversely across portions of the first set of openings in the adjacent longitudinal rows with the overlapping portions of the first and second sets of openings being arranged in longitudinally extending rows which extend along the beam paths.

19. A display device in accordance with claim 18 in which each of the transverse rows of the first set of openings in the second grid plate extends along a separate transverse row of the first set of openings in the first grid plate but each of the longitudinal rows of the first set of openings in the second grid plate is between two longitudinal rows of the first set of openings in the first grid plate and each of the transverse rows of the second set of openings in the second grid plate extends along a separate transverse row of the second set of openings in the first grid plate but each of the longitudinal rows of the second set of openings in the second grid plate is between two longitudinal rows of the second set of openings in the first grid plate.

20. A display device in accordance with claim 16 in which each of the transverse rows of openings in the second grid plate is longitudinally displaced slightly from a transverse row of the openings in the first grid plate in the direction along the beam paths away from the electron generating means.

21. In a display device which includes an evacuated envelope having closely spaced, substantially parallel front and back walls and a plurality of spaced, substantially parallel supports extending substantially perpendicularly between said front and back walls and forming a plurality of channels extending across said front and back walls, a phosphor screen along the inner surface of said front wall in each of the channels, means at one end of said channels for generating and directing electrons along each of said channels, and guide means along each of said channels for confining the electrons in at least one beam which travels in a substantially straight path longitudinally along the channel but permitting the beam to be deflected out of the guide means toward the phosphor screen at selected points along the path, the improvement comprising said guide means including a plurality of spaced conductors adjacent to the inner surface of the back wall and extending transversely across the channel, a grid plate spaced from and parallel to said back wall and extending transversely across the channel, said grid plate having a plurality of spaced openings therethrough, said openings being arranged in at least one row extending longitudinally along the channel with there being a longitudinal row of the openings for each beam in the channel, and means extending longitudinally along said channel for creating forces which laterally confine each beam to its beam path.

22. A display device in accordance with claim 21 in which the conductors include a first set each of which extends across a separate opening in each of the rows of openings in the grid plate, and a second set each of which extends between a pair of the conductors of the first set.

23. A display device in accordance with claim 22 in which the grid plate includes a first set of spaced parallel cross members extending transversely across the channel and a second set of spaced parallel cross members extending longitudinally along the channel, said cross members forming therebetween the openings in the grid member, each of the first set of cross members extending along a separate one of the second set of conductors.

24. A display device in accordance with claim 23 in which the guide means includes a second grid plate between the first said grid plate and the screen, said second grid plate having a plurality of openings therethrough with each of said openings being in alignment with a separate opening in the first grid plate.

25. A display device in accordance with claim 24 in which the means for creating forces which laterally confine its beams includes a plurality of electrodes extending between the first grid and the conductors with each of the electrodes extending longitudinally along a separate one of the second set of cross members.

26. A display device in accordance with claim 24 in which the means for creating forces which laterally confine the beams includes projections on each of the second set of conductors which projections extend along the second set of cross members.

27. A display device in accordance with claim 26 in which each of the first set of conductors includes first regions of a shape and size corresponding to and positioned in alignment with a separate opening in the first grid plate and narrow connecting regions extending between said first regions across the first set of cross members, and the projections on the second set of conductors extend between the first regions toward the connecting regions.

28. A display device in accordance with claim 21 in which said grid plate is between the conductors and the beam path and includes a row of openings along each of said beam paths, and a second grid plate is in spaced parallel relation to said first grid plate between the beam path and the screen, said second grid plate having spaced openings therein each of which is at least partially across at least one of the openings in the first grid plate.

29. A display device in accordance with claim 28 in which the openings in each of the grid plates are arranged in rows extending transversely across the beam paths and in rows extending longitudinally along the beam paths, the openings in each of the longitudinal rows extending laterally across at least one of the beam paths, and each transverse row of the openings extending along a separate one of the conductors.

30. A display device in accordance with claim 29 in which each of the openings in the second grid plate extends across a separate opening in the first grid plate and each of the longitudinal rows of the openings extends along a separate beam path.

31. A display device in accordance with claim 28 in which each grid plate includes a first set of openings arranged in rows extending transversely across and longitudinally along the beam paths and a second set of openings in rows extending transversely across and longitudinally along the beam path, each transverse row of said second set of openings being between a pair of transverse rows of said first set of openings and each longitudinal row of said second set of openings being between two longitudinal rows of the first set of openings and each of said second set of openings extending transversely across portions of the first set of openings in the adjacent longitudinal rows with the overlapping portions of the first and second sets of openings being arranged in longitudinally extending rows which extend along the beam paths.

32. A display device in accordance with claim 31 in which each of the transverse rows of the first set of openings in the second grid plate extends along a separate transverse row of the first set of openings in the first grid plate but each of the longitudinal rows of the first set of openings in the second grid plate is between two longitudinal rows of the first set of openings in the first grid plate and each of the transverse rows of the second set of openings in the second grid plate extends along a separate transverse row of the second set of openings in the first grid plate but each of the longitudinal rows of the second set of openings in the second grid plate is between two longitudinal rows of the second set of openings in the first grid plate.

33. A display device in accordance with claim 28 in which each of the transverse rows of openings in the second grid plate is longitudinally displaced slightly from a transverse row of the openings in the first grid plate in the direction along the beam paths away from the electron generating means.

* * * * *